US006250226B1

(12) United States Patent
Leichter et al.

(10) Patent No.: US 6,250,226 B1
(45) Date of Patent: Jun. 26, 2001

(54) NON-LETHAL AMMUNITION WITH INCAPACITATING EFFECT

(75) Inventors: Geneviève Leichter, Pibrac; Michel Castarede, Saint-Orens; Bruno Gromek, Muret, all of (FR)

(73) Assignee: Etienne Lacroix Tous Artifices S.A. (FR)

( * ) Notice: Subject to any disclaimer, the term of this patent is extended or adjusted under 35 U.S.C. 154(b) by 0 days.

(21) Appl. No.: 09/202,848

(22) PCT Filed: Jun. 21, 1996

(86) PCT No.: PCT/FR96/00973

§ 371 Date: May 24, 1999

§ 102(e) Date: May 24, 1999

(87) PCT Pub. No.: WO97/49968

PCT Pub. Date: Dec. 31, 1997

(51) Int. Cl.[7] ..... F42B 27/00
(52) U.S. Cl. ..... 102/370; 102/367; 102/368
(58) Field of Search ..... 102/370, 367, 102/368

(56) References Cited

U.S. PATENT DOCUMENTS 3,117,521 * 1/1964 Reaves ..... 102/368
3,402,665 * 9/1968 Tarpley, Jr. et al. ..... 102/368
3,785,569 * 1/1974 Helmrich ..... 239/337
4,195,572 4/1980 Knapp .
4,667,601 5/1987 Diamond .
4,932,672 * 6/1990 Tippmann ..... 273/428

FOREIGN PATENT DOCUMENTS

WO91/01479 2/1991 (DE) .

* cited by examiner

*Primary Examiner*—Charles T. Jordan
*Assistant Examiner*—Lulit Semunegus
(74) *Attorney, Agent, or Firm*—Blakely Sokoloff Taylor & Zafman

(57) ABSTRACT

The present invention relates to a non-lethal ammunition comprising a projectile (100) including: a body (110) which houses a container (130) adapted to generate a pressurized gas, and a nosecone (140) associated with a striker (154) adapted to enable an active agent to be dispersed on impact, wherein the body (110) is placed in a case (50, 60) and the container (130) or the striker is disposed on a slide (120) guided to slide in the body (110); means (117, 118, 119) are provided to prevent movement of the slide (120) before the body (110) leaves the case (50, 60) to prevent movement towards each other of the striker (154) and the container (130), and the body (110) of the projectile (100) comprises a plurality of orifices (170) disposed around its axis to enable the active agent to be dispersed omnidirectionally.

27 Claims, 5 Drawing Sheets

FIG_1
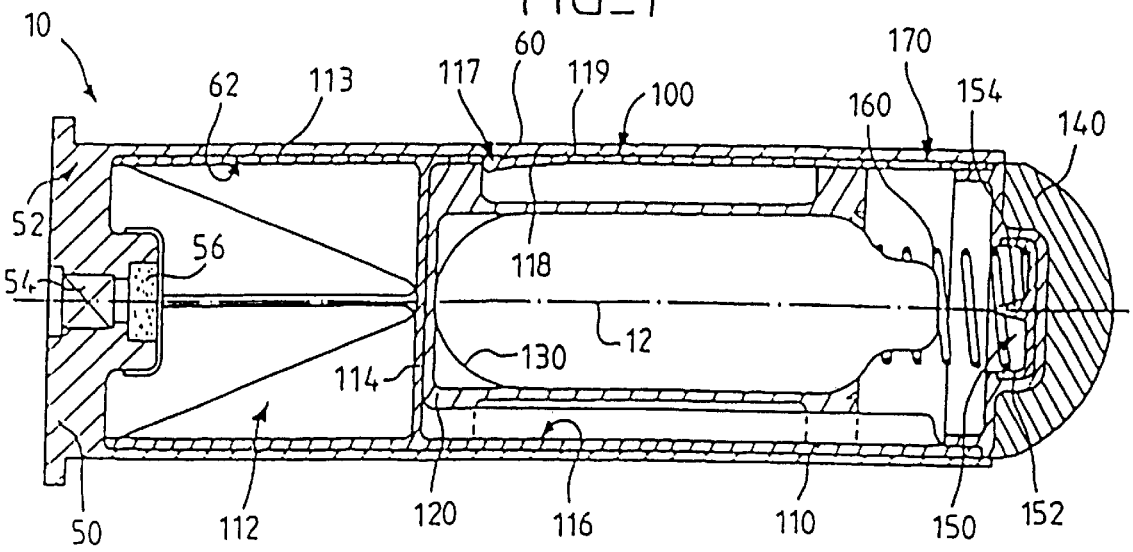
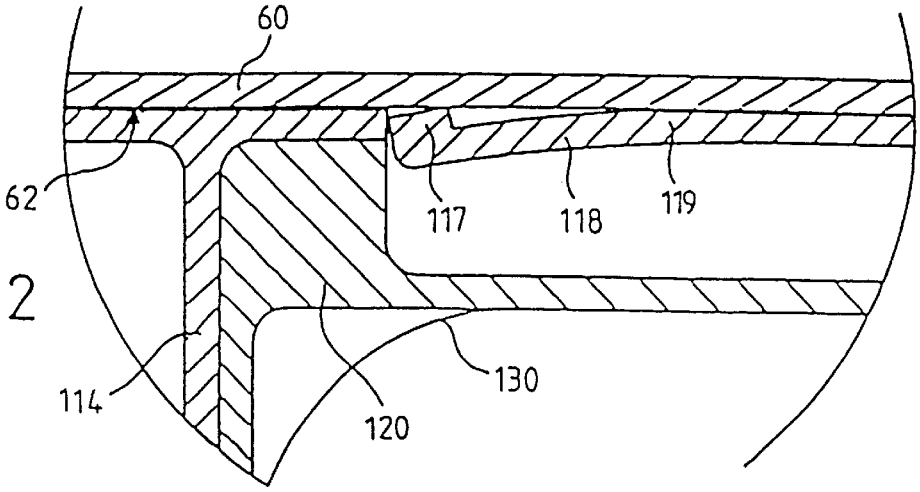
FIG_2
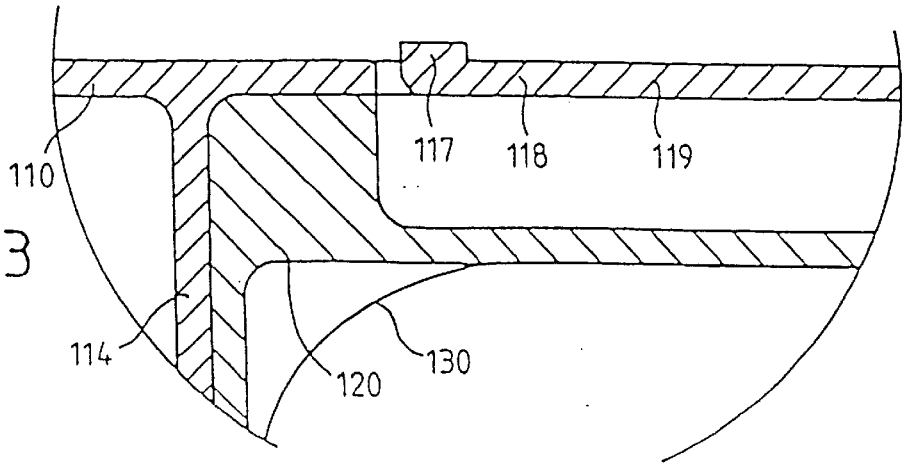
FIG_3

FIG_6A
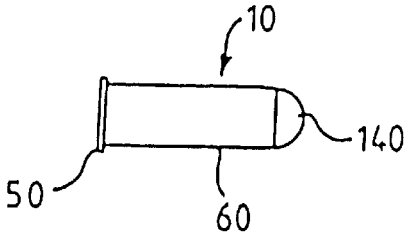
FIG_6B
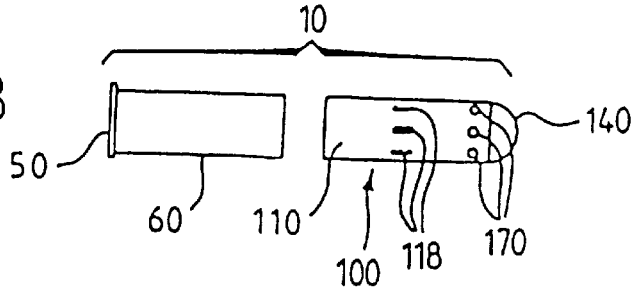
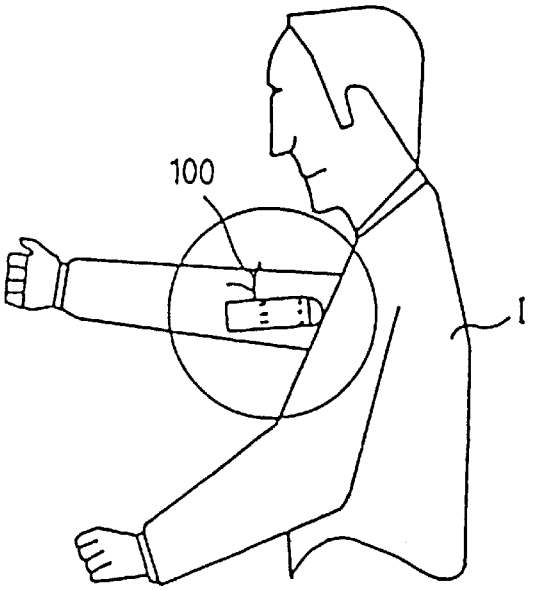
FIG_6C
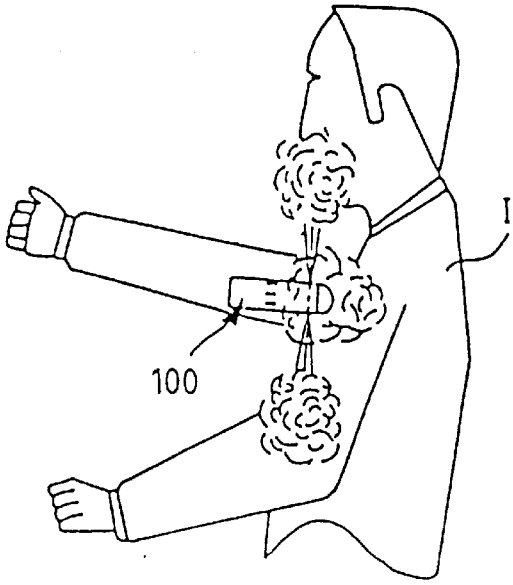
FIG_6D

NON-LETHAL AMMUNITION WITH INCAPACITATING EFFECT

The present invention concerns non-lethal ammunition.

The present invention applies in particular, although not exclusively, to ammunition for dispersing a substance having an incapacitating effect.

The aim of the present invention is to propose new non-lethal ammunition, for example with incapacitating effect, that is reliable, simple in design, and economic.

This aim is achieved in accordance with the present invention by non-lethal ammunition comprising a projectile which includes:

a body which houses:

a container adapted to generate a pressurized gas, and a nosecone associated with a striker adapted to enable an active agent to be dispersed on impact, wherein the body is placed in a case and the container or the striker is disposed on a slide guided to slide in the body, means are provided to prevent movement of the slide before the body leaves the case to prevent movement towards each other of the striker and the container, and the body of the projectile comprises a plurality of orifices disposed around its axis to enable the active agent to be dispersed omnidirectionally.

Figure 5:
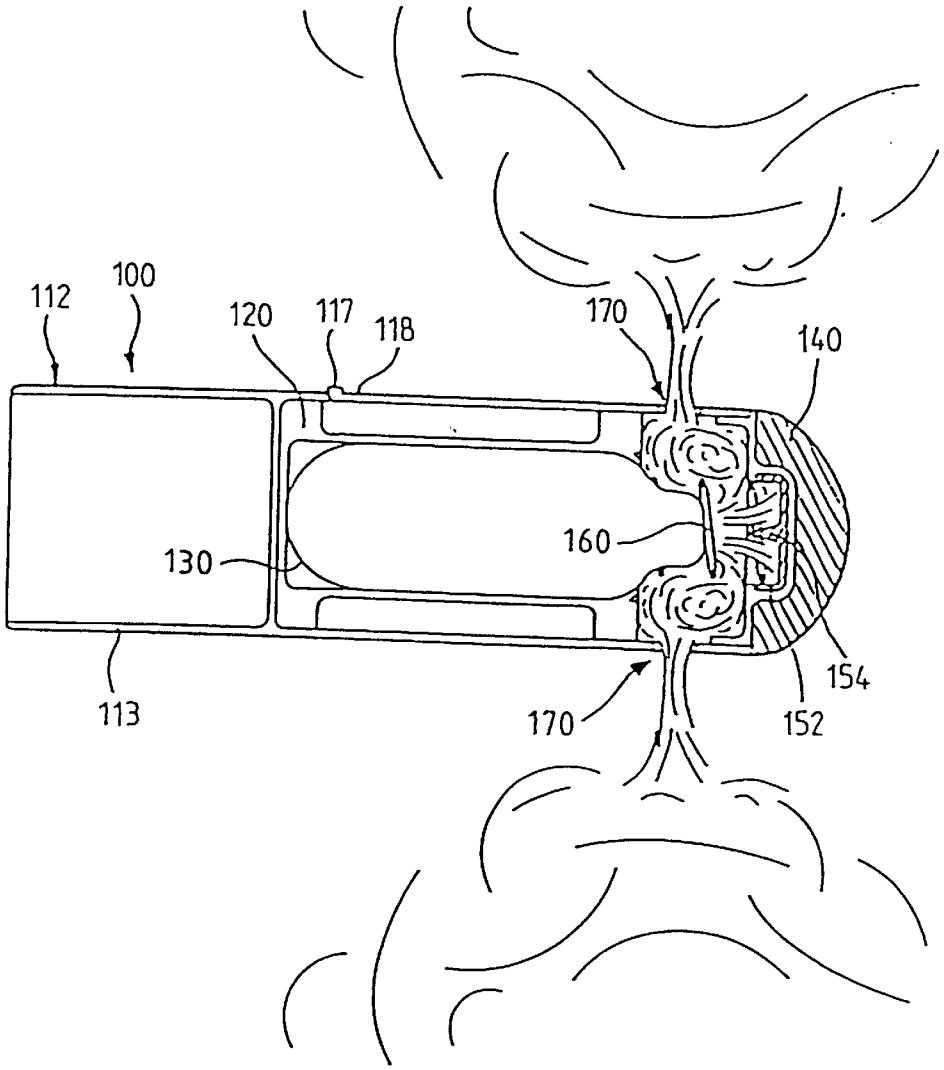
Figure 4:
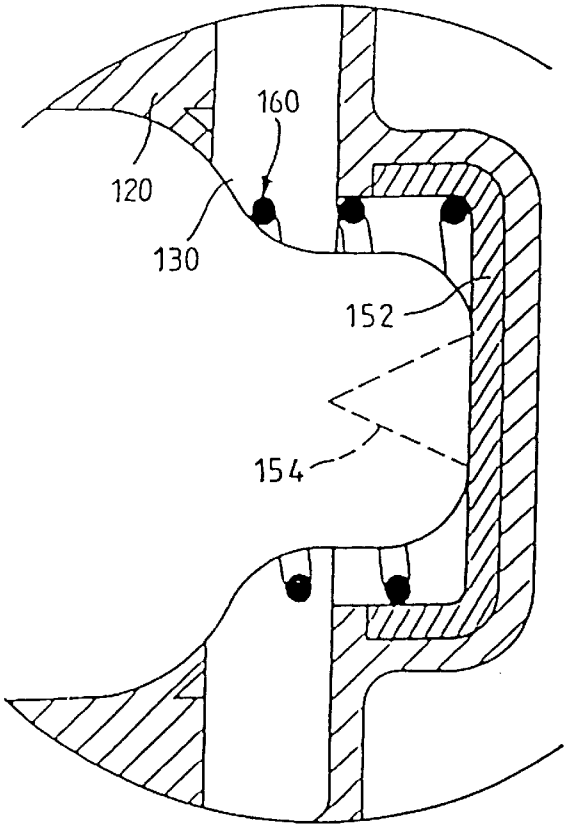
Figure 7:
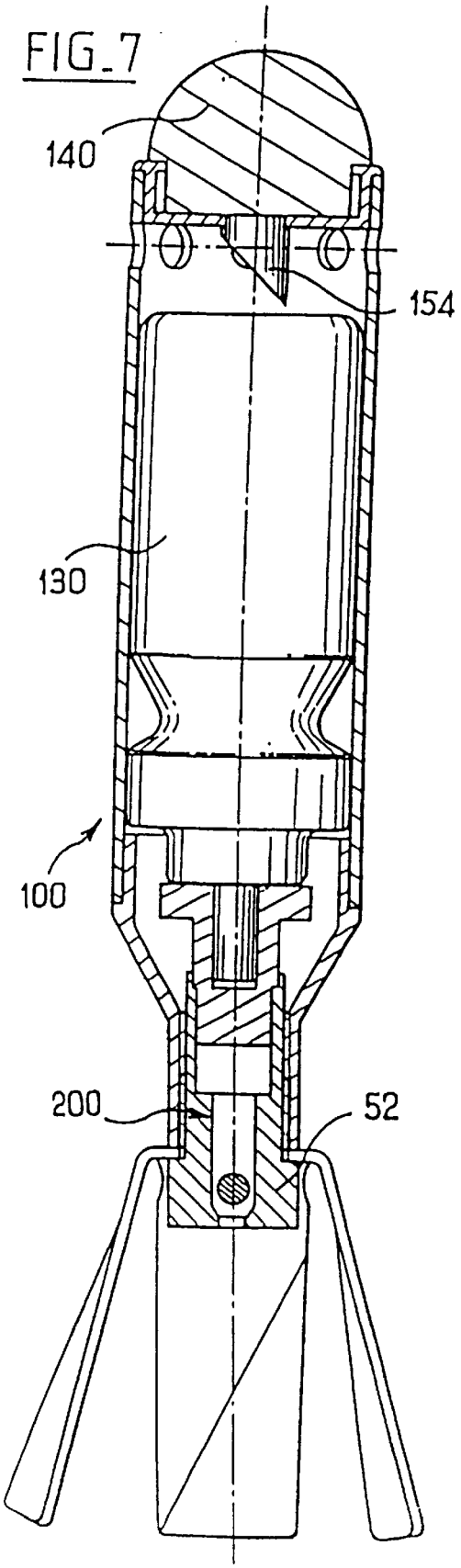
Figure 8:
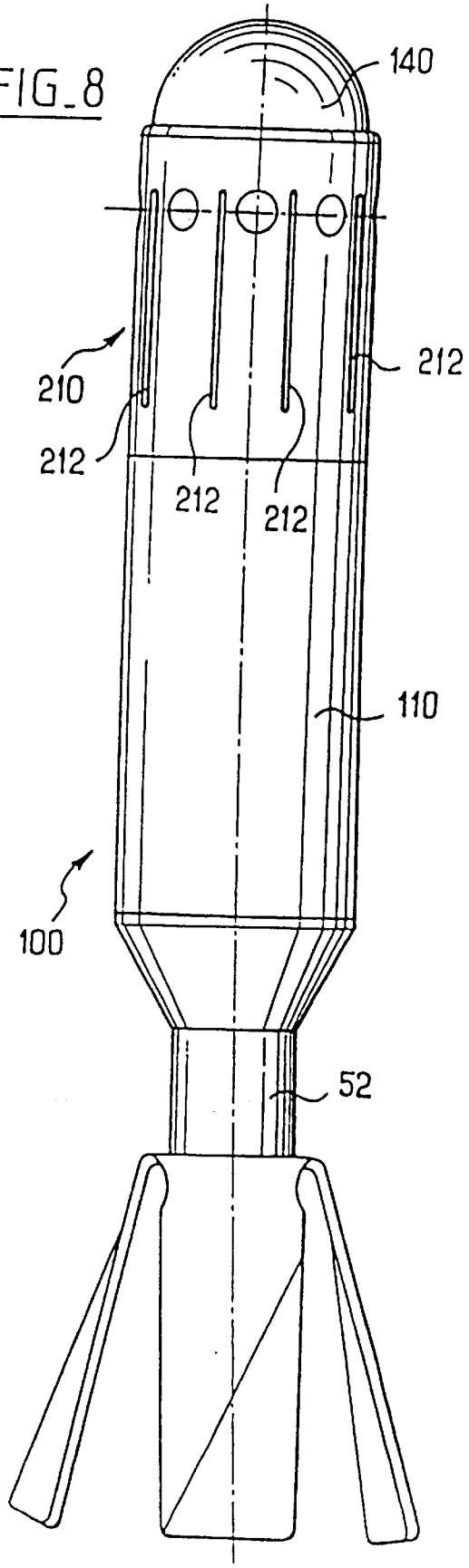
Figure 9:
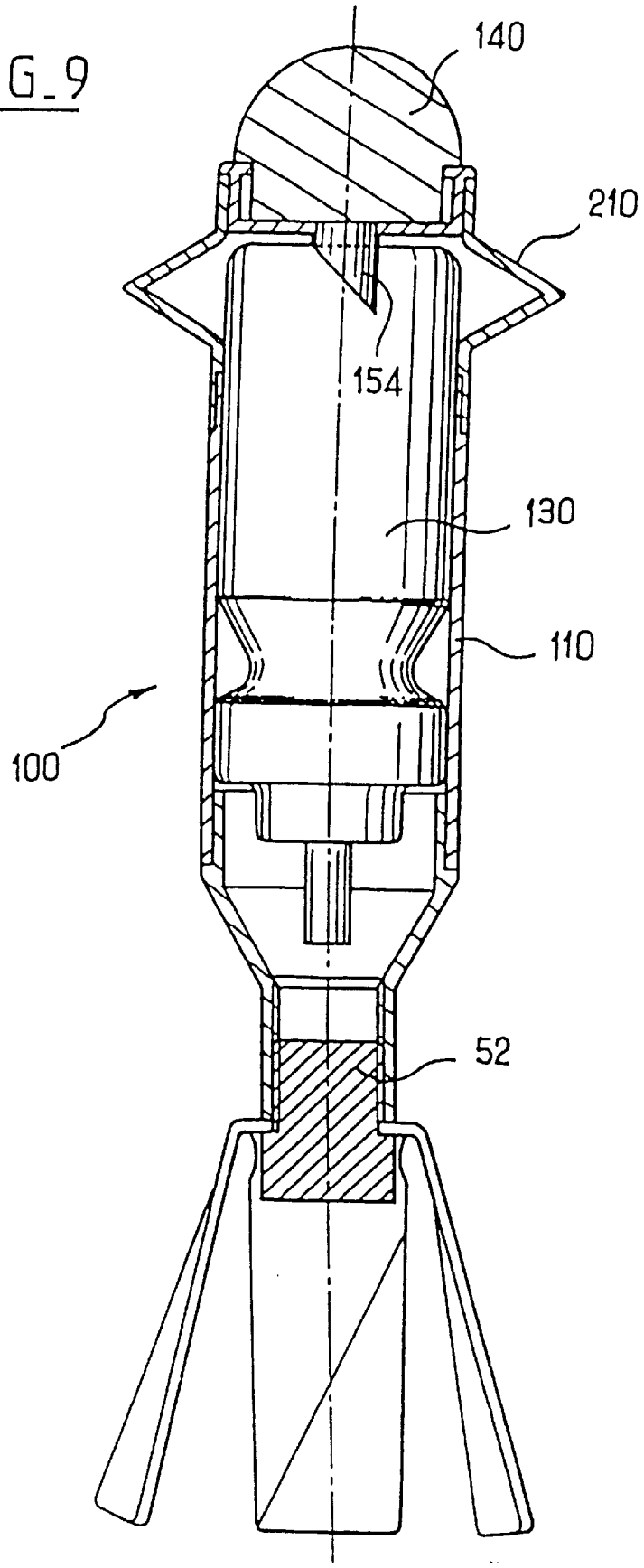

Further features, aims and advantages of the present invention become apparent on reading the following detailed description and from the accompanying drawings given by way of non-limiting example and in which:

FIG. 1 is a diagrammatic view in longitudinal axial section of ammunition in accordance with the present invention, FIGS. 2 and 3 are two partial views to a larger scale and similar to FIG. 1 respectively showing the status of means for immobilizing the slider before and after ejection of the projectile out of the case, FIG. 4 is a partial view to a larger scale similar to FIG. 1 of the head of the projectile after impact, FIG. 5 is a diagrammatic view in longitudinal axial section of a projectile in accordance with the present invention after impact, FIGS. 6A, 6B, 6C and 6D are diagrams representing four successive stages in the use of ammunition in accordance with the present invention, and FIGS. 7, 8 and 9 show variants of projectiles in accordance with the invention, respectively in longitudinal section in FIG. 7, in external lateral view in FIG. 8 and in longitudinal section after operation in FIG. 9.

The first embodiment shown in FIGS. 1 through 6 is described first.

The ammunition 10 in accordance with the present invention shown in the appended figures essentially comprises a case 50 housing a projectile 100. Originally, i.e. during storage, the ammunition 10 formed of the case 50 and the projectile 100 is centered on a longitudinal axis 12.

The case 50 essentially comprises a hollow base 52 extended forwards by a cylindrical skirt 60 centered on the axis 12. The base 52 houses means for ejecting/propelling the projectile 100.

A non-limiting example of the ejection/propulsion means comprises an initiator 54 associated with a pyrotechnic charge 56 forming a propulsion gas generator discharging into the internal chamber 62 of the case 50, i.e. onto the rear of the projectile 100.

In an embodiment, the case 50 can be a launcher tube.

The projectile 100 essentially comprises a body 110, a slide 120, a container 130 of propulsive gas under pressure, and an incapacitating agent and a nosecone 140 associated with a striker 150.

The body 110 preferably has a cylindrical envelope complementary to the chamber 62 inside the case 50. The body 110 preferably has at its rear end stabilizing means 112 such as a skirt 113, for example, possibly perforated or louvered to improve stability, or even having fins. The skirt 113 can be flexible to expand on exiting the launcher to define a stabilizing tail. Approximately one third along its length from its rear end the body 110 has a transverse partition 114. The slide 120 and the container 130 are disposed in the chamber 116 of the body 110 in front of the transverse partition 114.

The nosecone 140 is fixed to the front end of the body 110. The nosecone 140 therefore closes off the mouth of the chamber 116 formed in the body 110. The nosecone 140 is preferably rubber-based and preferably has a convex hemispherical envelope.

The striker 150 is disposed on the inside face of the nosecone 140. The striker 150 can be formed by a cup 152, for example, having a central spike 154 the pointed end of which faces towards the rear, i.e. towards the front end of the container 130.

The slide 120 is placed between the transverse partition 114 and the striker 154. The slide 120 is guided to slide along the axis 12 inside the chamber 116 in the body 110.

The container 130 is disposed on the slide 120, i.e. between the striker 154 and the back wall of the slide 120 adjacent the transverse partition 114.

In a preferred embodiment of the present invention the container 130 contains an incapacitating agent and a pressurized propellant gas, preferably an aerosol and a pressurized gas serving as a propellant for the aerosol after the container 130 ruptures.

A spring 160 such as a coil spring is disposed between the front end of the container 130 and the striker 154.

The invention additionally provides safety means to prevent movement of the slide 120 and consequently of the container 130 towards the striker 154 before the body 110 leaves the case 60.

The safety means can be of various kinds.

In the preferred embodiment shown in the accompanying drawings the safety means comprise at least one tongue 118 in one piece with the body 110 and deformed elastically towards the interior of the chamber 116 when the projectile 100 is placed in the case 60 to serve as an abutment for the slide 120.

As explained hereinafter, when the projectile 100 leaves the case 60, the tongue 118 releases the slide 120 and consequently the container 130.

There is preferably a plurality of tongues 118 equiangularly distributed around the axis 12.

Each tongue 118 is preferably formed of a blade joined to the body 110 at its front end 119, a protuberance 117 being provided on the outside face of the rear end of the tongue 118.

The ammunition in accordance with the present invention shown in the accompanying drawings and the construction of which has just been described functions in essentially the following manner.

In the storage configuration (see FIGS. 1, 2 and 6A) the projectile 100 is inside the case 50, 60. Each tongue 118 is deformed towards the inside of the chamber 116 by the outer case 60, the protuberance 117 resting on the inside surface of the skirt 60. In this way the tongue(s) hold the slide 120 and the container 130 away from the striker 154. However, after the projectile 100 has been expelled from the case 60 by the means 54, 56 there is no longer any external bearing surface for the protuberance 117, as previously formed by the case 60. The tongue 118 can therefore return resiliently to its rest position aligned with the thickness of the wall of the body 110 (FIGS. 3 and 6B). The slide 120 is therefore able to move along the axis 12 inside the body 110.

This arms the projectile 100.

Nevertheless, the spring 160 prevents any unintentional movement of the slide 120 and the container 130 towards the striker 154.

The range and velocity of the projectile 100 defined by the power of the propulsion means 54 and 56 are adapted to prevent injury to a person 1 at whom the projectile 100 is fired.

On impacting on a person 1 the result deceleration of the projectile 100 causes rapid forward movement of the slide 120 and the container 130 against the striker 154, compressing the spring 160.

The container 130 is perforated when its front end is struck by the striker 154.

The incapacitating agent contained in the container 130, which is in the form of an aerosol, for example, can then be released and dispersed by the propellant gas stored under pressure in the container 130 (FIG. 4). The incapacitating agent can be dispersed more effectively if, as shown in FIG. 5, the spring 160 subsequently withdraws the slide and the container 130 from the striker 154 to remove the striker 154 from the perforation it has made in the wall of the container 130.

The incapacitating agent in the container 130 is dispersed through at least one orifice 170 formed in the wall of the body 110 near its front end.

As can be seen in FIGS. 5 and 6 in particular there is preferably a plurality of orifices 170 equiangularly distributed around the axis 12 at the front end of the body 110, i.e. immediately to the rear of the nosecone 140. This arrangement enables the active agent contained in the projectile to be dispersed omnidirectionally.

Of course the present invention is not limited to the particular embodiment described above, but encompasses any variant thereof within the spirit of the Nor is the present invention limited to dispersing a particular active agent. Although it is preferably concerned with dispersing an incapacitating agent, it applies equally to dispersing active agents of various kinds, for example paint, or even a combination of several active agents.

The active agent can take numerous forms, including (this list is not limiting on the invention): powders, in particular powders in a solvent, smoke producers, and aerosols.

Prior to impact, the active agent can be stored in the same container as the pressurized propellant gas or in a separate chamber.

The pressurized gas can be stored permanently in the container 130 of the projectile or transferred into the container 130 at the time the projectile 100 is fired by transferring some of the gases generated by the means 54 and 56 into the container 130 through a valve provided for this purpose in the rear part of the container 130.

In a further embodiment the gas dispersing the active agent can be generated by pyrotechnic means initiated on impact with the striker 154.

The embodiment shown in FIGS. 7, 8 and 9 is described below. FIGS. 7 through 9 show non-lethal ammunition in accordance with the present invention comprising a body 110 housing a container 130 adapted to generate a gas under pressure and a nosecone 140 associated with a striker 154 adapted to enable an active agent to be dispersed on impact. The structure of the projectile shown in FIGS. 7 through 9 is therefore not be described in detail below.

The emphasis is on describing essentially the main features that distinguish the projectile shown in FIGS. 7 through 9 from the projectile described above with reference to FIGS. 1 through 6.

Firstly, the projectile shown in FIGS. 7 through 9 is characterized by the presence of means assuring its self-destruction in the event of a malfunction.

Here the self-destruct means are preferably formed by a time-fuse 200 in the base 52 of the projectile. The time-fuse 200 is initiated when the projectile is fired. If the projectile has not operated normally by perforation of the container 130 after a particular time period, for example if the projectile misses its target, at the end of its combustion the time-fuse 200 generates a volume of gas that forces the container 130 against the striker 154.

Secondly, to guarantee that it is non-lethal, the projectile shown in FIGS. 7 through 9 has an improved nosecone 140 in the form of a hemispherical dome, preferably of silicone, having a Shore A hardness in the range 10 to 30 and most preferably in the range 12 to 15.

Thirdly, the projectile shown in FIGS. 7 through 9 is characterized by a deformable structure 210 adjacent the nosecone 140.

A deformable structure 210 of the above kind can be of many different kinds.

In the preferred embodiment shown in FIG. 8 the deformable structure 210 is the front part of the body 100 and is in the form of a thin metal envelope, for example 0.1 mm to 0.5 mm thick, possibly weakened beforehand, for example by longitudinal markings 212 distributed around the periphery of the body 110.

A deformable structure 210 of the above kind absorbs some energy on impact.

FIG. 9 shows a variant adapted to operate by inertia and which encourages dispersion of the active agent, for example aerosol, on impact. To be more precise, FIG. 9 shows the status of the projectile after it has operated, i.e. after the striker has impacted on the container 130 due to deformation of the structure 210.

Note that the FIG. 9 variant does not have any time-fuse 200.

The deformable structure 210 can of course take various forms, for example a deformable. In one particular embodiment it can be a plastically deformable impact absorber at the front end of the projectile in the form of an aluminum tube adapted to collapse upon itself to absorb some of the kinetic energy on impact and to convert it into plastic deformation energy.

FIGS. 7 through 9 show that the slide can be formed by the casing of the container 130 (or the body can itself support the striker 154).

In the embodiments previously described the striker is fixed and the container can move. The reverse arrangement can be used, i.e. the container can be fixed and the striker mobile on impact.

What is claimed is:

1. Non-lethal ammunition comprising a projectile (100) including:

a body (110) which houses:

a container (130) adapted to generate a pressurized gas, and a nosecone (140) associated with a striker (154) adapted to enable an active agent to be dispersed on impact, wherein the body (110) is placed in a case (50, 60) and the container (130) or the striker is disposed on a slide (120) guided to slide in the body (110), means (117, 118, 119) are provided to prevent movement of the slide (120) before the body (110) leaves the case (50, 60) to prevent movement towards each other of the striker (154) and the container (130), and the body (110) of the projectile (100) comprises a plurality of orifices (170) disposed around its axis to enable the active agent to be dispersed omnidirectionally.

2. Ammunition according to claim 1, characterized in that the active agent is an agent with incapacitating effect.

3. Ammunition according to claim 1, characterized in that the active agent is paint.

4. Ammunition according to claim 1, characterized in that the pressurized gas is stored permanently in said container.

5. Ammunition according to claim 1, the container (130) is provided with a valve suitable for transferring propellant gases into the container (130) when the projectile (100) is fired.

6. Ammunition according to claim 1, characterized in that the pressurized gas is generated by pyrotechnic means initiated on impact with the striker (154).

7. Ammunition according to claim 1, characterized in that the active agent is stored in the same container (130) as the pressurized propellant gas.

8. Ammunition according to claim 1, characterized in that prior to impact the active agent is stored in a separate chamber from the pressurized propellant gas.

9. Ammunition according to claim 1, characterized in that the container (130) is adapted to strike the striker (154) on impact.

10. Ammunition according to claim 1, characterized in that the container (130) is adapted to be perforated by the striker (154) on impact.

11. Ammunition according to claim 1, characterized in that the striker (154) is adapted to initiate a pyrotechnic system on impact.

12. Ammunition according to claim 1, characterized in that the means preventing movement of the slide comprise at least one tongue (118) in one piece with the body (110) and deformed elastically towards the interior of the chamber of the body housing the slide (120) when the projectile (100) is placed in the case (50, 60).

13. Ammunition according to claim 12, characterized in that it comprises a plurality of tongues (118) equiangularly distributed around its axis.

14. Ammunition according to claim 12, characterized in that each tongue (118) is connected to the body (110) at its front end (119) and has a protuberance (117) on the outside face of its rear end.

15. Ammunition according to claim 1, characterized by a spring (160) between the container (130) and the striker (154).

16. Ammunition according to claim 1, characterized in that the projectile (100) comprises a rubber nosecone (140).

17. Ammunition according to claim 1, characterized in that the container (130) contains an aerosol and a pressurized gas forming a propellant for the aerosol.

18. Ammunition according to claim 1, characterized in that is comprises self-destruct means (200).

19. Ammunition according to claim 18, characterized in that the self-destruct means (200) are adapted to perforate the container (130) after a predetermined time after the projectile (100) is fired.

20. Ammunition according to claim 18, characterized in that the self-destruct means comprise a time-fuse (200) initiated when the projectile is fired and adapted to generate gases for moving the container (130) and the striker (154) towards each other.

21. Ammunition according to claim 1, characterized in that the nosecone (140) is made of silicone.

22. Ammunition according to claim 1 characterized in that the nosecone (140) has a Shore A hardness in the range 10 to 30.

23. Ammunition according to claim 1, characterized in that it comprises a deformable structure forming a damper (210) adjacent the nosecone (140).

24. Ammunition according to claim 22, wherein the nosecone (140) has a Shore A hardness in the range 12 to 15.

25. Non-lethal ammunition comprising:

a case (50, 60) and a projectile (100) provided in the case (50, 60) and including:

a body (110) which houses:

a container (130) adapted to generate a pressurized gas, and a nosecone (140) associated with a striker (154) adapted to enable an active agent to be dispersed on impact, wherein the body (110) is placed in the case (50, 60) and the container (130) or the striker is disposed on a slide (120) guided to slide in the body (110), means (117, 118, 119) are provided to prevent movement of the slide (120) before the body (110) leaves the case (50, 60) to prevent movement towards each other of the striker (154) and the container (130), and the body (110) of the projectile (100) comprises a plurality of orifices 9170) disposed around its axis to enable the active agent to be dispersed omnidirectionally, and wherein the means preventing movement of the slide comprise at least one tongue (118) in one piece with the body (110) and deformed elastically towards the interior of the chamber of the body housing the slide (120) when the projectile (100) is placed in the case (50, 60).

26. Ammunition according to claim 25, characterized in that it comprises a plurality of tongues (118) equiangularly distributed around its axis.

27. Ammunition according to claim 25 or claim 26, characterized in that each tongue (118) is connected to the body (110) at its front end (119) and has a protuberance (117) on the outside face of its rear end.

* * * * *